US006227137B1

(12) United States Patent
Allen et al.

(10) Patent No.: US 6,227,137 B1
(45) **Date of Patent: *May 8, 2001**

(54) SPAR PLATFORM WITH SPACED BUOYANCY

(75) Inventors: Donald Wayne Allen, Katy; Dean Leroy Henning, Needville; Stephen W. Balint, Houston; David Wayne McMillan, Deer Park, all of TX (US)

(73) Assignee: Shell Oil Company, Houston, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/997,630

(22) Filed: Dec. 23, 1997

Related U.S. Application Data

(60) Provisional application No. 60/034,469, filed on Dec. 31, 1996.

(51) Int. Cl.[7] ..... B63B 35/44

(52) U.S. Cl. ..... 114/264

(58) Field of Search ..... 114/243, 264, 114/265, 266

(56) References Cited

U.S. PATENT DOCUMENTS

| | | | |
|---|---|---|---|
| H611 | 4/1989 | Peace | 114/264 |
| 2,986,889 | 6/1961 | Ludwig | 61/46.5 |
| 3,407,766 | 10/1968 | Bergman et al. | 114/5 |
| 3,407,767 | 10/1968 | McClintock et al. | 114/5 |
| 3,460,501 | 8/1969 | Silverman | 114/5 |
| 3,500,783 | 3/1970 | Johnson, Jr. et al. | 114/5 |
| 3,510,692 | 5/1970 | Hufford | 307/284 |
| 3,510,892 | 5/1970 | Monnereau et al. | 9/8 |
| 3,572,041 | 3/1971 | Graaf | 61/46.5 |
| 3,916,633 | 11/1975 | Lovie et al. | 61/46.5 |
| 3,951,086 | 4/1976 | Lown et al. | 114/5 D |
| 3,978,804 | 9/1976 | Beynet et al. | 114/5 D |
| 4,155,673 | 5/1979 | Yashima | 405/224 |
| 4,312,288 | 1/1982 | Finsterwalder et al. | 114/264 |
| 4,378,179 | 3/1983 | Hasle | 405/227 |
| 4,398,487 | 8/1983 | Ortloff et al. | 114/243 |
| 4,473,323 | 9/1984 | Gregory | 405/224 |
| 4,505,620 | 3/1985 | Andrier | 405/224 |

(List continued on next page.)

FOREIGN PATENT DOCUMENTS

| | | |
|---|---|---|
| 2 540 065 | 8/1984 | (FR) . |
| 2 118 903 | 11/1983 | (GB) . |
| 2 310 407 | 8/1997 | (GB) . |

OTHER PUBLICATIONS

J. A. van Santen and K. de Werk, "On the Typical Qualities of SPAR Type Structures for Initial or Permanent Field Development," OTC 2716, paper presented at the Offshore Technology Conference, Houston, Texas, May 3–6, 1976.

F. Joseph Fischer et al., "Current–Induced Oscillations of Cognac Piles During Installation——Prediction and Measurement," Practical Experiences with Flow–Induced Vibrations, Symposium Karlsruhe/Germany, Sep. 3–6, 1979, University of Karlsruhe, pp. 570–581.

Armin W. Troesch, Associate Professor (Principal Investigator), "Hydrodynamic Forces on Bodies Undergoing Small Amplitude Oscillations in a Uniform Stream" (Completion of existing UM/Sea Grant/Industry consortium project), 19 pages.

*Primary Examiner*—Stephen Avila

(57) ABSTRACT

The present invention is a spar platform having a deck supported by a buoyant tank assembly having a first buoyant section connected to the deck, a second buoyant section disposed beneath the first buoyant section; and a buoyant section spacing structure connecting the first and second buoyant sections in manner providing a horizontally extending vertical gap therebetween. A counterweight is connected to the buoyant tank assembly through a counterweight spacing structure.

59 Claims, 5 Drawing Sheets

U.S. PATENT DOCUMENTS

| | | | | |
|---|---|---|---|---|
| 4,630,968 | | 12/1986 | Brethet et al. | 405/195 |
| 4,674,918 | * | 6/1987 | Kalpins | 114/264 |
| 4,685,833 | | 8/1987 | Iwamoto | 405/195 |
| 4,700,651 | * | 10/1987 | Hale | 114/243 |
| 4,702,321 | | 10/1987 | Horton | 166/350 |
| 4,768,984 | | 9/1988 | de Oliveira et al. | 441/21 |
| 4,829,928 | * | 5/1989 | Bergman | 114/264 |
| 4,987,846 | | 1/1991 | Yamashita et al. | 114/265 |
| 5,558,467 | | 9/1996 | Horton | 405/195.1 |
| 5,722,797 | | 3/1998 | Horton, III | 405/224 |

* cited by examiner

SPAR PLATFORM WITH SPACED BUOYANCY

CROSS-REFERENCE TO RELATED APPLICATION

This application claims the benefit of U.S. Provisional Patent Application Ser. No. 60/034,469, filed Dec. 31, 1996.

BACKGROUND OF THE INVENTION

The present invention relates to a heave resistant, deep-water platform supporting structure known as a "spar." More particularly, the present invention relates to reducing the susceptibility of spars to drag and vortex induced vibrations ("VIV").

Efforts to economically develop offshore oil and gas fields in ever deeper water create many unique engineering challenges. One of these challenges is providing a suitable surface accessible structure. Spars provide a promising answer for meeting these challenges. Spar designs provide a heave resistant, floating structure characterized by an elongated, vertically disposed hull. Most often this hull is cylindrical, buoyant at the top and with ballast at the base. The hull is anchored to the ocean floor through risers, tethers, and/or mooring lines.

Though resistant to heave, spars are not immune from the rigors of the offshore environment. The typical single column profile of the hull is particularly susceptible to VIV problems in the presence of a passing current. These currents cause vortexes to shed from the sides of the hull, inducing vibrations that can hinder normal drilling and/or production operations and lead to the failure of the anchoring members or other critical structural elements.

Helical strakes and shrouds have been used or proposed for such applications to reduce vortex induced vibrations. Strakes and shrouds can be made to be effective regardless of the orientation of the current to the marine element. But shrouds and strakes materially increase the drag on such large marine elements.

Thus, there is a clear need for a low drag, VIV reducing system suitable for deployment in protecting the hull of a spar type offshore structure.

SUMMARY OF THE INVENTION

The present invention is a spar platform having a deck supported by a buoyant tank assembly having a first buoyant section connected to the deck, a second buoyant section disposed beneath the first buoyant section; and a buoyant section spacing structure connecting the first and second buoyant sections in manner providing a horizontally extending vertical gap therebetween. A counterweight is connected to the buoyant tank assembly through a counterweight spacing structure.

BRIEF DESCRIPTION OF THE DRAWINGS

The description above, as well as further advantages of the present invention will be more fully appreciated by reference to the following detailed description of the illustrated embodiments which should be read in conjunction with the accompanying drawings in which.

DETAILED DESCRIPTION OF ILLUSTRATIVE EMBODIMENTS

Figure 1:
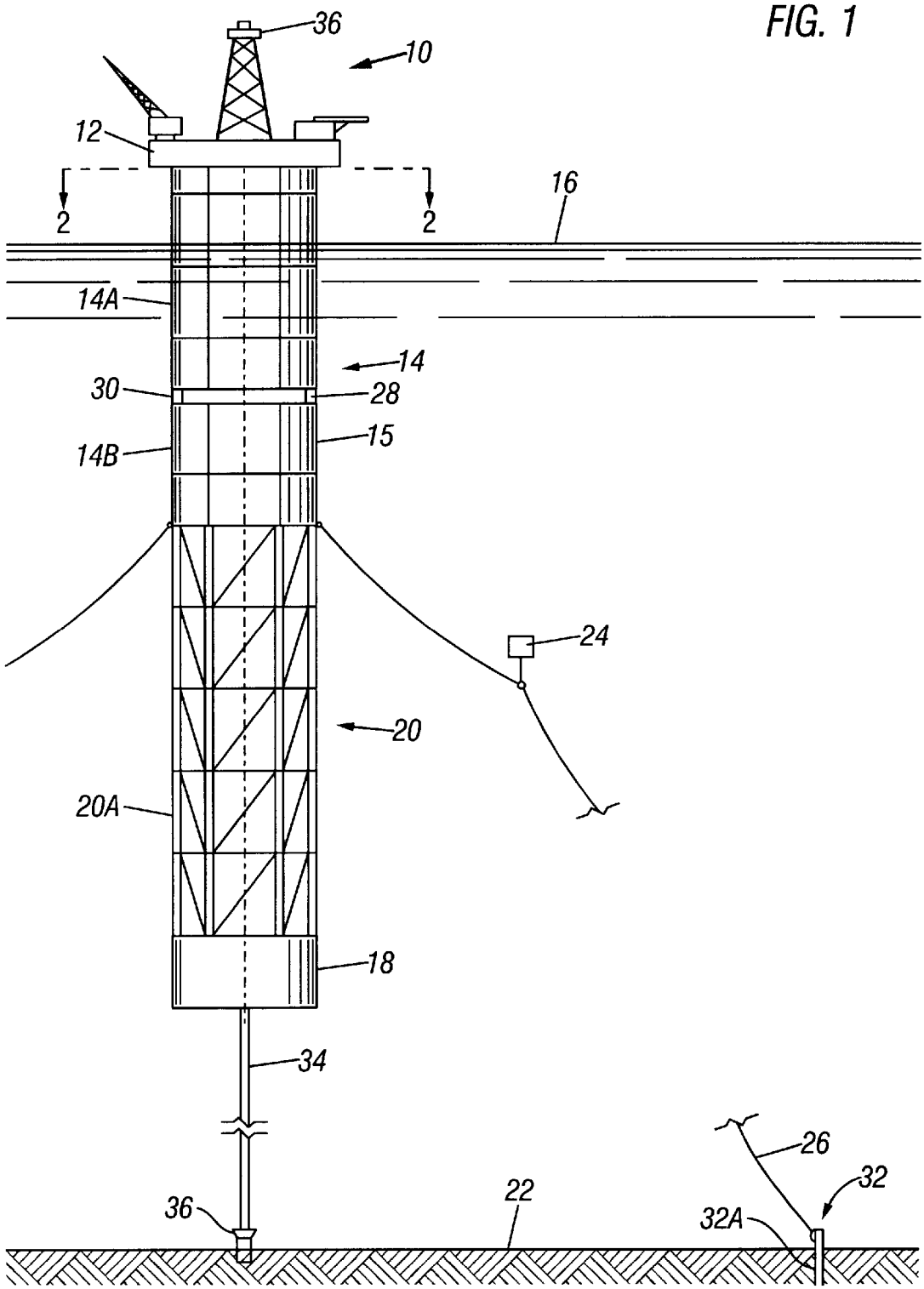
FIG. 1 is a side elevational view of one embodiment of a spar platform with spaced buoyancy in accordance with present invention.

FIG. 1 illustrates a spar 10 in accordance with the present invention. Spars are a broad class of floating, moored offshore structure characterized in that they are resistant to heave motions and present an elongated, vertically oriented hull 14 which is buoyant at the top, here buoyant tank assembly 15, and is ballasted at its base, here counterweight 18, which is separated from the top through a middle or counterweight spacing structure 20.

Figure 2:
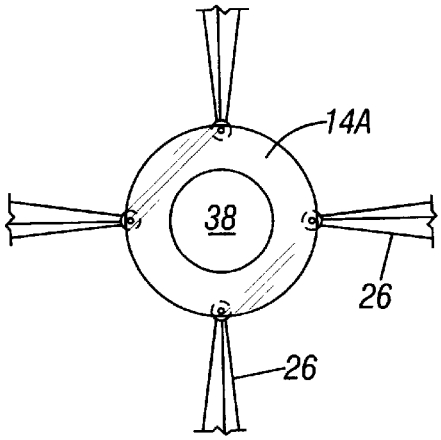
FIG. 2 is a cross sectional view of the spar of FIG. 1 taken at line 2—2 in FIG. 1.

Such spars may be deployed in a variety of sizes and configuration suited to their intended purpose ranging from drilling alone, drilling and production, or production alone. FIGS. 1 and 2 illustrate a drilling spar, but those skilled in the art may readily adapt appropriate spar configurations in accordance with the present invention for production operations alone or for combined drilling and production operations as well in the development of offshore hydrocarbon reserves.

In the illustrative example of FIGS. 1 and 2, spar 10 supports a deck 12 with a hull 14 having a plurality of spaced buoyancy sections, here first or upper buoyancy section 14A and second or lower buoyancy section 14B. These buoyancy sections are separated by buoyant section spacing structure 28 to provide a substantially open, horizontally extending vertical gap 30 between adjacent buoyancy sections. Here the buoyancy sections have equal diameters and divide the buoyant tank assembly 15 into sections of substantially equal length below the water line 16. Further, the height of gap 30 is substantially equal to 10% of the diameter of buoyant sections 14A and 14B.

A counterweight 18 is provided at the base of the spar and the counterweight is spaced from the buoyancy sections by a counterweight spacing structure 20. Counterweight 18 may be in any number of configurations, e.g., cylindrical, hexagonal, square, etc., so long as the geometry lends itself to connection to counterweight spacing structure 20. In this embodiment, the counterweight is rectangular and counterweight spacing structure is provided by a substantially open truss framework 20A.

Mooring lines 26 secure the spar platform over the well site at ocean floor 22. In this embodiment the mooring lines are clustered (see FIG. 2) and provide characteristics of both taut and catenary mooring lines with buoys 24 included in the mooring system (see FIG. 1). The mooring lines terminate at their lower ends at anchor system 32, here piles 32A. The upper end of the mooring lines may extend upward through shoes, pulleys, etc. to winching facilities on deck 12 or the mooring lines may be more permanently attached at their departure from hull 14 at the base of buoyant tank assembly 15.

In FIG. 1, a drilling riser 34 is deployed beneath derrick 36 on deck 12 of spar platform 10. The drilling riser connects drilling equipment at the surface with well 36 at ocean floor 22 through a central moon pool 38, see FIG. 2.

A basic characteristic of the spar type structure is its heave resistance. However, the typical elongated, cylindrical hull elements, whether the single caisson of the "classic" spar or the buoyant tank assembly 15 of a truss-style spar, are very susceptible to vortex induced vibration ("VIV") in the presence of a passing current. These currents cause vortexes to shed from the sides of the hull 14, inducing vibrations that can hinder normal drilling and/or production operations and lead to the failure of the risers, mooring line connections or other critical structural elements. Premature fatigue failure is a particular concern.

Prior efforts at suppressing VIV in spar hulls have centered on strakes and shrouds. However both of these efforts have tended to produce structures having high drag coefficients, rendering the hull more susceptible to drift. This commits substantial increases in the robustness required in the anchoring system. Further, this is a substantial expense for structures that may have multiple elements extending from near the surface to the ocean floor and which are typically considered for water depths in excess of half a mile or so.

The present invention reduces VIV from currents, regardless of their angle of attack, by dividing the aspect ratio of the cylindrical elements in the spar with substantially open, horizontally extending, vertical gaps 30 at select intervals along the length of the cylindrical hull. A gap having a height of 10% or so diameter of the cylindrical element is sufficient to substantially disrupt the correlation of flow about the combined cylindrical elements and this benefit may be maximized with the fewest such gaps by dividing the combined cylindrical elements into sections of toughly equivalent aspect ratios. For typically sized truss-type spars, one such gap though the buoyant tank assembly may be sufficient relief as truss framework 20A forming the counterweight spacing structure 20 contributes little to the VIV response of the spar. Providing one or more gaps 30 also helps reduce the drag effects of current on spar hull 14.

Figure 3:
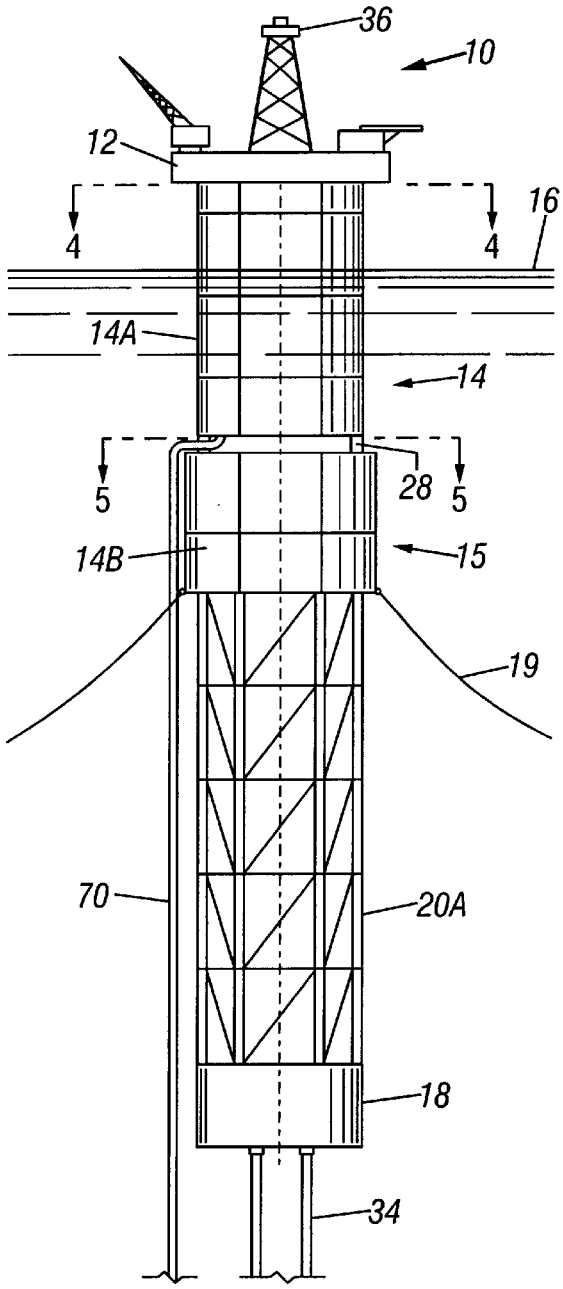
FIG. 3 is a side elevational view of an alternate embodiment of a spar platform with spaced buoyancy in accordance with the present invention.
Figure 4:
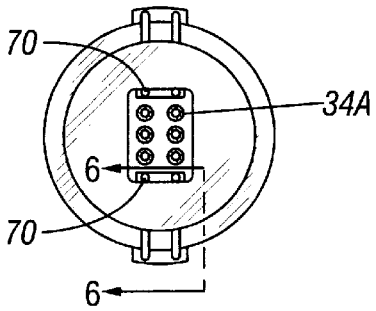
FIG. 4 is a cross sectional view of the spar platform of FIG. 3 taken at line 4—4 in FIG. 3.
Figure 5:
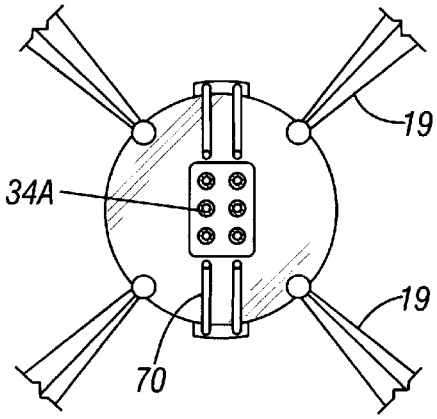
FIG. 5 is a cross sectional view of the spar platform of FIG. 3 taken at line 5—5 in FIG. 3.

FIGS. 3–5 illustrate a spar 10 in accordance with another embodiment of the present invention. In this illustration, spar 10 is a production spar with a derrick 36 for workover operations. Buoyant tank assembly 15 supports a deck 12 with a hull 14 having two spaced buoyancy sections 14A and 14B, of unequal diameter. A counterweight 18 is provided at the base of the spar and the counterweight is spaced from the buoyancy sections by a substantially open truss framework 20A. Mooring lines 19 secure the spar platform over the well site.

Production risers 34A connect wells or manifolds at the seafloor (not shown) to surface completions at deck 12 to provide a flowline for producing hydrocarbons from subsea reservoirs. Here risers 34A extend through an interior or central moonpool 38 illustrated in the cross sectional views of FIGS. 4 and 5.

Figure 7:
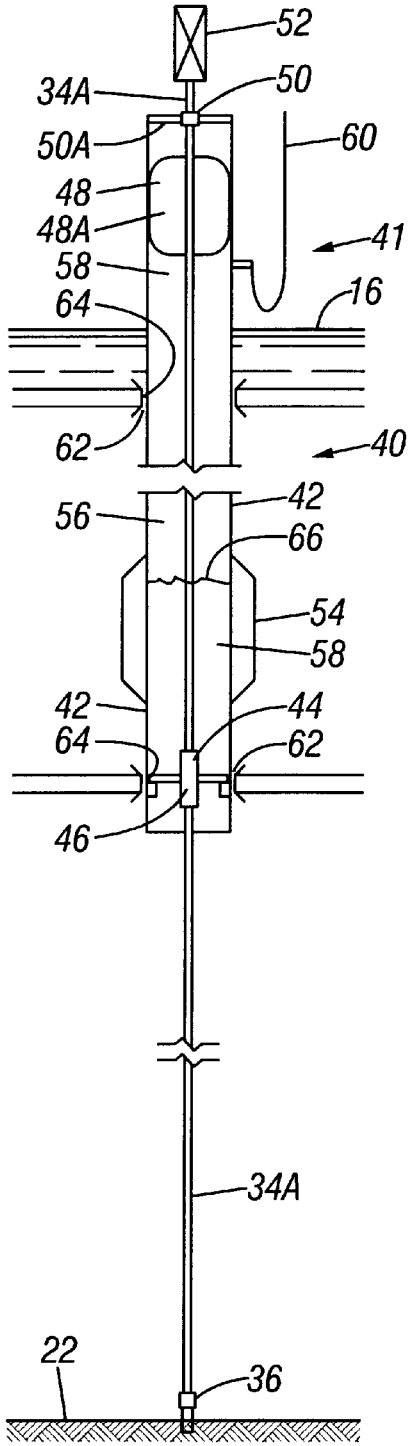
FIG. 7 is a schematically rendered cross sectional view of a riser system useful with embodiments of the present invention.
Figure 8:
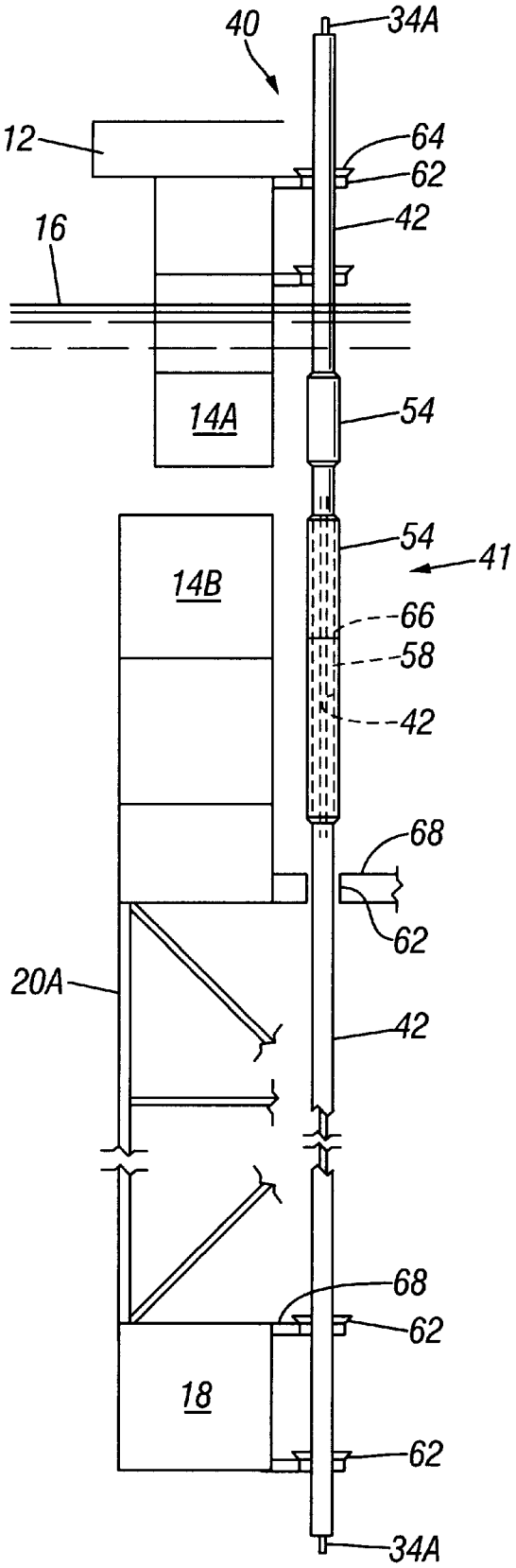
FIG. 8 is a side elevational view of a riser system deployed in an embodiment of the present invention.

Spar platforms characteristically resist, but do not eliminate heave and pitch motions. Further, other dynamic response to environmental forces also contribute to relative motion between risers 34A and spar platform 10. Effective support for the risers which can accommodate this relative motion is critical because a net compressive load can buckle the riser and collapse the pathway within the riser necessary to conduct well fluids to the surface. Similarly, excess tension from uncompensated direct support can seriously damage the riser. FIGS. 7 and 8 illustrate a deepwater riser system 40 which can support the risers without the need for active, motion compensating riser tensioning systems.

FIG. 7 is a cross sectional schematic of a deepwater riser system 40 constructed in accordance with the present invention. Within the spar structure, production risers 34A run concentrically within buoyancy can tubes 42. One or more centralizers 44 secure this positioning. Here centralizer 44 is secured at the lower edge of the buoyancy can tube and is provided with a load transfer connection 46 in the form of an elastomeric flexjoint which takes axial load, but passes some flexure deformation and thereby serves to protect riser 34A from extreme bending moments that would result from a fixed riser to spar connection at the base of spar 10. In this embodiment, the bottom of the buoyancy can tube is otherwise open to the sea.

The top of the buoyancy tube can, however, is provided with an upper seal 48 and a load transfer connection 50. In this embodiment, the seal and load transfer function are separated, provided by inflatable packer 48A and spider 50A, respectively. However, these functions could be combined in a hanger/gasket assembly or otherwise provided. Riser 34A extends through seal 48 and connection 50 to present a Christmastree 52 adjacent production facilities, not shown. These are connected with a flexible conduit, also not shown. In this embodiment, the upper load transfer connection assumes a less axial load than lower load transfer connection 46 which takes the load of the production riser therebeneath. By contrast, the upper load connection only takes the riser load through the length of the spar, and this is only necessary to augment the riser lateral support provided the production riser by the concentric buoyancy can tube surrounding the riser.

External buoyancy tanks, here provided by hard tanks 54, are provided about the periphery of the relatively large diameter buoyancy can tube 42 and provide sufficient buoyancy to at least float an unloaded buoyancy can tube. In some applications it may be desirable for the hard tanks or other form of external buoyancy tanks 54 to provide some redundancy in overall riser support.

Additional, load bearing buoyancy is provided to buoyancy can assembly 41 by presence of a gas 56, e.g., air or nitrogen, in the annulus 58 between buoyancy can tube 42 and riser 34A beneath seal 48. A pressure charging system 60 provides this gas and drives water out the bottom of buoyancy can tube 42 to establish the load bearing buoyant force in the riser system.

Load transfer connections 46 and 50 provide a relatively fixed support from buoyancy can assembly 41 to riser 34A. Relative motion between spar 10 and the connected riser/buoyancy assembly is accommodated at riser guide structures 62 which include wear resistant bushings within riser guides tubes 64. The wear interface is between the guide tubes and the large diameter buoyancy can tubes and risers 34A are protected.

FIG. 8 is a side elevational view of a deepwater riser system 40 in a partially cross-sectioned spar 10 having two buoyancy sections 14A and 14B, of unequal diameter, separated by a gap 30. A counterweight 18 is provided at the base of the spar, spaced from the buoyancy sections by a substantially open truss framework 20A.

The relatively small diameter production riser 34A runs through the relatively large diameter buoyancy can tube 42.

Hard tanks 54 are attached about buoyancy can tube 42 and a gas injected into annulus 58 drives the water/gas interface 66 within buoyancy can tube 42 far down buoyancy can assembly 41.

Buoyancy can assembly 41 is slidingly received through a plurality of riser guides 62. The riser guide structure provides a guide tube 64 for each deepwater riser system 40, all interconnected in a structural framework connected to hull 14 of the spar. Further, in this embodiment, a significant density of structural conductor framework is provided at such levels to tie conductor guide structures 62 for the entire riser array to the spar hull. Further, this can include a plate 68 across moonpool 38.

The density of conductor framing and/or horizontal plates 68 serve to dampen heave of the spar. Further, the entrapped mass of water impinged by this horizontal structure is useful in otherwise tuning the dynamics of the spar, both in defining harmonics and inertia response. Yet this viral mass is provided with minimal steel and without significantly increasing the buoyancy requirements of the spar.

Horizontal obstructions across the moonpool of a spar with spaced buoyancy section may also improve dynamic response by impeding the passage of dynamic wave pressures through gap 30, up moonpool 38. Other placement levels of the conductor guide framework, horizontal plates, or other horizontal impinging structure may be useful, whether across the moonpool, as outward projections from the spar, or even as a component of the relative sizes of the upper and lower buoyancy sections, 14A and 14B, respectively.

Further, vertical impinging surfaces such as the additional of vertical plates at various levels in open truss framework 20A may similarly enhance pitch dynamics for the spar with effective entrapped mass.

Another optional feature of this embodiment is the absence of hard tanks 54 adjacent gap 30. Gap 30 in this spar design controls vortex induced vibration ("VIV") on the cylindrical buoyancy sections 14 by dividing the aspect ratio (diameter to height below the water line) with two, spaced buoyancy sections 14A and 14B having similar volumes and, e.g., a separation of about 10% of the diameter of the upper buoyancy section. Further, the gap reduces drag on the spar, regardless of the direction of current. Both these benefits requires the ability of current to pass through the spar at the gap. Therefore, reducing the outer diameter of a plurality of deepwater riser systems at this gap may facilitate these benefits.

Figure 6:
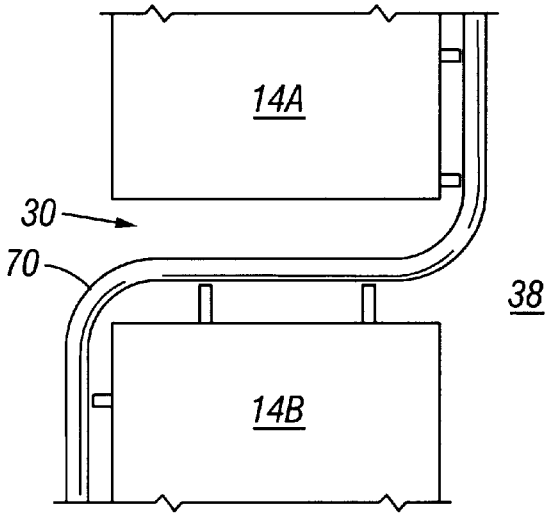
FIG. 6 is a cross sectional view of the spar platform of FIG. 3 taken at line 6—6 in FIG. 4.

Another benefit of gap 30 is that it allows passage of import and export steel catenary risers 70 mounted exteriorly of lower buoyancy section 14B to the moonpool 38. See FIG. 6 and also FIGS. 3–5. This provides the benefits and convenience of hanging these risers exterior to the hull of the spar, but provide the protection of having these inside the moonpool near the water line 16 where collision damage presents the greatest risk and provides a concentration of lines that facilitates efficient processing facilities. Import and export risers 70 are secured by standoffs and clamps above their major load connection to the spar. Below this connection, they drop in a catenary lie to the seafloor im a manner that accepts vertical motion at the surface more readily than the vertical access production risers 34A.

Supported by hard tans 54 alone (without a pressure charged source of annular buoyancy), unsealed and open top buoyancy can tubes 42 can serve much like well conductors on traditional fixed platforms. Thus, the large diameter of the buoyancy can tube allows passage of equipment such as a guide funnel and compact mud mat in preparation for drilling, a drilling riser with an integrated tieback connector for drilling, surface casing with a connection pod, a compact subsea tree or other valve assemblies, a compact wireline lubricator for workover operations, etc. as well as the production riser and its tieback connector. Such other tools may be conventionally supported from a derrick, gantry crane, or the like throughout operations, as is the production riser itself during installation operations.

After production riser 34A is run (with centralizer 44 attached) and makes up with the well, seal 48 is established, the annulus is charged with gas and seawater is evacuated, and the load of the production riser is transferred to the buoyancy can assembly 41 as the deballasted assembly rises and load transfer connections at the top and bottom of assembly 41 engage to support riser 34A.

Figure 9:
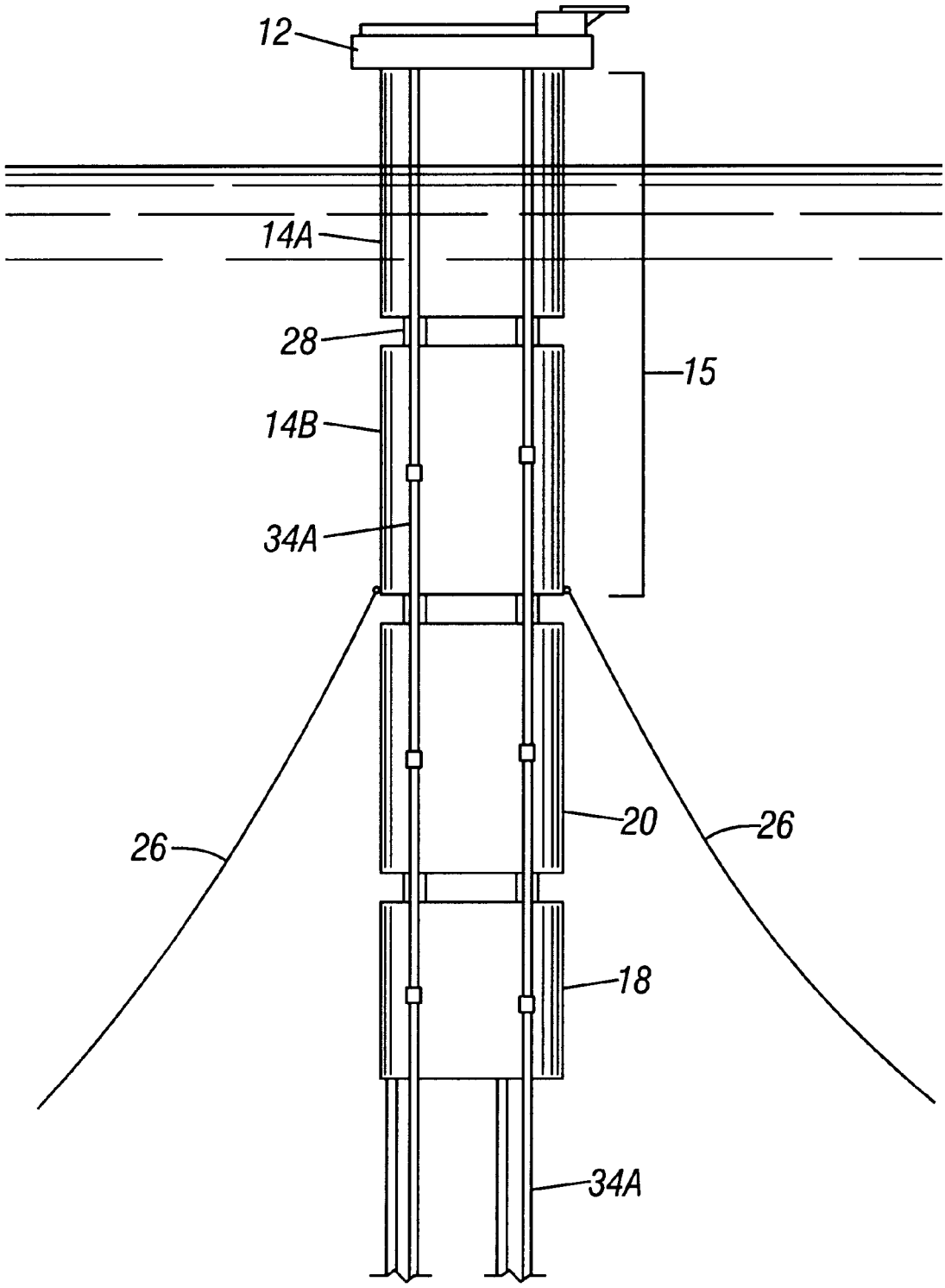
FIG. 9 is a side elevational view of another embodiment of the present invention.

It should be understood that although most of the illustrative embodiments presented here deploy the present invention in spars with interior moon pools 38 and a substantially open truss 20A separating the buoyant sections from the counterweight 18; it is clear that the VIV suppression and drag reduction of present invention is not limited to this sort of spar embodiment. Such measures may be deployed for spars having no moonpool and exteriorly run vertical access production riser 34A or may be deployed in "classic spars" 10 in which the buoyant tank assembly 15, counterweight spacing structure 20, and counterweight 18 are all provided in the profile of a single elongated cylindrical hull disrupted only by the gaps of the present invention. See, for example, FIG. 9 illustrating both these configuration aspects.

It should also be appreciated that dividing the buoyant tank assembly into multiple buoyant sections facilitates a modular approach to building spars in which facility requirements and attendant deck loads can be accommodated by adding or changing one or more of the buoyant sections rather than redesigning the entire spar as an integral cylindrical unit as. e.g., a "classic" spar.

Further, other modifications, changes and substitutions are intended in the foregoing disclosure and in some instances some features of the invention will be employed without a corresponding use of other features. Accordingly, it is appropriate that the appended claims be construed broadly and in the manner consistent with the spirit and scope of the invention herein.

What is claimed is:

1. A spar platform comprising:

a deck;

a buoyant tank assembly, comprising:

a first buoyant section connected to the deck;

a second buoyant section disposed beneath the first buoyant section; and a rigid buoyant section spacing structure connecting the first and second buoyant sections in manner providing a horizontally extending vertical gap therebetween;

a counterweight; and a counterweight spacing structure connecting the counterweight to the buoyant tank assembly.

2. A spar platform in accordance with claim 1, further comprising an anchor system.

3. A spar platform in accordance with claim 2 wherein the anchor system comprises a plurality of mooring lines.

4. A spar platform in accordance with claim 1 wherein a vertically extending open moon pool is defined through the first buoyant sections.

5. A spar platform in accordance with claim 4, further comprising:

one or more import risers passing to the deck through the moon pool; and one or more export risers passing to the deck through the moon pool.

6. A spar platform in accordance with claim 4 wherein the moon pool is further defined through the second buoyant section, the counterweight spacing structure, and the counterweight.

7. A spar platform in accordance with claim 6 further comprising a plurality of vertically extending production risers extending upwardly through the full length of the moon pool to the deck.

8. A spar platform in accordance with claim 1 wherein the first and second buoyant sections are enclosed cylindrical elements and the spar platform further comprises a plurality of risers extending upwardly to the deck, externally to the first and second buoyant members.

9. A spar platform in accordance with claim 1 wherein the counterweight spacing structure is a cylinder.

10. A spar platform in accordance with claim 9 wherein the first and second buoyant sections are coaxially and vertically aligned cylindrical elements.

11. A spar platform in accordance with claim 10 wherein the first and second buoyant sections are of substantially equal diameters.

12. A spar platform in accordance with claim 11 wherein the first and second buoyant sections have substantially equal volumes.

13. A spar platform comprising:

a deck;

a buoyant tank assembly, comprising:

a first buoyant section connected to the deck;

a second buoyant section disposed beneath the first buoyant section; and a buoyant section spacing structure connecting the first and second buoyant sections in manner providing a horizontally extending vertical gap therebetween having a height that is about 10% of the width of the first buoyant section;

a counterweight; and a counterweight spacing structure connecting the counterweight to the buoyant tank assembly.

14. A spar platform comprising:

a deck;

a buoyant tank assembly, comprising:

a first cylindrical buoyant section connected to the deck;

a second cylindrical buoyant section disposed beneath and coaxially and vertically aligned with the first cylindrical buoyant section; and a buoyant section spacing structure connecting the first and second buoyant sections in manner providing a horizontally extending vertical gap therebetween having a height that is about 10% of the diameter of the first cylindrical buoyant section;

a counterweight; and a cylinder providing a counterweight spacing structure connecting the counterweight to the buoyant tank assembly.

15. A drilling spar comprising:

a deck;

drilling facilities supported by the deck;

a buoyant tank assembly, comprising:

a first cylindrical buoyant section connected to the deck;

a second cylindrical buoyant section disposed beneath the first buoyant section; and a buoyant section spacing structure connecting the first and second buoyant sections in manner providing a substantially open horizontally extending vertical gap therebetween, the height of the horizontally extending vertical gap between the first and second cylindrical buoyant sections being about 10% of the diameter of the first cylindrical buoyant section;

a counterweight; and a counterweight spacing structure in the form of an open truss connecting the counterweight to the buoyant tank assembly;

a vertically extending open moon pool is defined through the first and second buoyant sections, the counterweight spacing structure, and the counterweight;

a drilling riser supported by the deck in vertical alignment with the drilling facilities and extending downwardly through the moon pool; and an anchor system comprising a plurality of mooring lines connected to the seafloor on one end and adjacent the bottom of the second cylindrical buoyant section on the other end.

16. A drilling and production spar comprising:

a deck;

drilling facilities supported by the deck;

production facilities supported by the deck;

a buoyant tank assembly, comprising:

a first cylindrical buoyant section connected to the deck;

a second cylindrical buoyant section disposed beneath the first buoyant section; and a buoyant section spacing structure substantially rigidly connecting the first and second buoyant sections in manner providing a substantially open horizontally extending vertical gap therebetween;

a counterweight; and a counterweight spacing structure connecting the counterweight to the buoyant tank assembly;

a vertically extending open moon pool is defined through the first and second buoyant sections, the counterweight spacing structure, and the counterweight;

a drilling riser supported by the deck in vertical alignment with the drilling facilities and extending downwardly through the moon pool;

one or more production risers connected to the production facilities, supported by the deck, and extending downwardly through the moon pool;

one or more export risers connected to the production facilities passing to the deck through the moon pool; and an anchor system comprising a plurality of mooring lines connected to the seafloor on one end and adjacent the bottom of the second cylindrical buoyant section on the other end.

17. A spar platform in accordance with claim 16 wherein the counterweight spacing structure is a truss.

18. A spar in accordance with claim 16 wherein height of the horizontally extending vertical gap between the first and second buoyant sections is about 10% of the diameter of the first buoyant section.

19. A spar platform in accordance with claim 18 wherein the first and second buoyant sections are of substantially equal aspect ratios.

20. A drilling spar comprising:

a deck;

drilling facilities supported by the deck;

a buoyant tank assembly, comprising:

a first cylindrical buoyant section connected to the deck;

a second cylindrical buoyant section disposed beneath the first buoyant section; and a buoyant section spacing structure connecting the first and second buoyant sections in manner providing a substantially open horizontally extending vertical gap therebetween;

whereby an aspect ratio of the spar platform is reduced and vortex induced vibration is mitigated;

a counterweight; and a low drag counterweight spacing structure in the form of an open truss connecting the counterweight to the buoyant tank assembly;

a vertically extending open moon pool is defined through the first and second buoyant sections, the counterweight spacing structure, and the counterweight;

a drilling riser supported by the deck in vertical alignment with the drilling facilities and extending downwardly through the moon pool; and an anchor system comprising a plurality of mooring lines connected to the seafloor on one end and adjacent the bottom of the second cylindrical buoyant section on the other end.

21. A spar in accordance with claim 20 wherein height of the horizontally extending vertical gap between the first and second cylindrical buoyant sections is about 10% of the diameter of the first cylindrical buoyant section.

22. A spar platform in accordance with claim 21 wherein the first and second cylindrical buoyant sections are of substantially equal diameters and have substantially equal volumes.

23. A production spar comprising:

a deck;

production facilities supported by the deck;

a buoyant tank assembly, comprising:

a first cylindrical buoyant section connected to the deck;

a second cylindrical buoyant section disposed beneath the first buoyant section; and a buoyant section spacing structure connecting the first and second buoyant sections in a substantially rigid manner providing a substantially open horizontally extending vertical gap therebetween;

a counterweight; and a counterweight spacing structure in the form of an open truss connecting the counterweight to the buoyant tank assembly;

a vertically extending open moon pool is defined through the first and second buoyant sections, the counterweight spacing structure, and the counterweight;

one or more production risers connected to the production facilities and supported by the deck;

one or more export risers connected to the production facilities; and an anchor system comprising a plurality of mooring lines connected to the seafloor on one end and adjacent the bottom of the second cylindrical buoyant section on the other end.

24. A spar in accordance with claim 23 wherein height of the horizontally extending vertical gap between the first and second buoyant sections is about 10% of the diameter of the first buoyant section.

25. A spar platform in accordance with claim 24 wherein the first and second buoyant sections are of substantially equal diameters and have substantially equal volumes below the water line.

26. A spar platform in accordance with claim 25, further comprising a vertically extending open moon pool defined through the first and second buoyant sections, the counterweight spacing structure, and the counterweight through which the production risers pass.

27. A spar platform in accordance with claim 26 further comprising one or more import risers connected to the production facilities.

28. A method for reducing vortex induced vibrations in a spar platform having a deck, a buoyant tank assembly, a counterweight and an counterweight spacing structure, the method comprising reducing the aspect ratio of the spar platform by providing one or more substantially open horizontally extending vertical gaps below the water line between the deck and the counterweight.

29. A method for reducing vortex induced vibrations in a spar platform in accordance with claim 28 wherein reducing the aspect ratio of the spar platform further comprises placing one of the substantially open vertically extending gaps in the buoyant tank assembly as a space provided between vertically aligned cylindrical buoyant sections and sizing the height of the gap at about 10% of the diameter of the buoyant tank assembly.

30. A method for reducing vortex vortex induced vibrations in a spar platform in accordance with claim 29 further comprising reducing vortex induced vibrations and drag by forming the counterweight spacing structure from a horizontally open truss framework.

31. A spar platform comprising:

a deck;

a buoyant tank assembly, comprising:

a first buoyant section connected to the deck;

a second buoyant section disposed beneath the first buoyant section wherein the first and second buoyant sections have substantially similar horizontal cross sections and of substantially equal volume; and a buoyant section spacing structure connecting the first and second buoyant sections in manner providing a horizontally extending vertical gap therebetween;

a counterweight; and a counterweight spacing structure connecting the counterweight to the buoyant tank assembly.

32. A spar platform comprising:

a deck;

a buoyant tank assembly, comprising:

a first buoyant section connected to the deck;

a second buoyant section disposed beneath the first buoyant section the first and second buoyant sections being coaxially and vertically aligned cylindrical elements having substantially equal diameters; and a buoyant section spacing structure connecting the first and second buoyant sections in manner providing a horizontally extending vertical gap therebetween;

a counterweight; and a cylinder as a counterweight spacing structure connecting the counterweight to the buoyant tank assembly.

33. A spar platform in accordance with claim 32 wherein the first and second buoyant sections have substantially equal volumes.

34. A drilling and production spar comprising:

a deck;

drilling facilities supported by the deck;

production facilities supported by the deck;

a buoyant tank assembly, comprising:

a first cylindrical buoyant section connected to the deck;

a second cylindrical buoyant section disposed beneath the first buoyant section, the first and second buoyant sections are of substantially equal aspect ratios; and a buoyant section spacing structure connecting the first and second buoyant sections in manner providing a substantially open horizontally extending vertical gap therebetween of about 10% of the diameter of the first buoyant section;

a counterweight; and a counterweight spacing structure connecting the counterweight to the buoyant tank assembly;

a vertically extending open moon pool is defined through the first and second buoyant sections, the counterweight spacing structure, and the counterweight;

a drilling riser supported by the deck in vertical alignment with the drilling facilities and extending downwardly through the moon pool;

one or more production risers connected to the production facilities, supported by the deck, and extending downwardly through the moon pool;

one or more export risers connected to the production facilities passing to the deck through the moon pool; and an anchor system comprising a plurality of mooring lines connected to the seafloor on one end and adjacent the bottom of the second cylindrical buoyant section on the other end.

35. A drilling spar comprising:

a deck;

drilling facilities supported by the deck;

a buoyant tank assembly, comprising:

a first cylindrical buoyant section connected to the deck;

a second cylindrical buoyant section disposed beneath the first buoyant section wherein the first and second cylindrical buoyant sections are of substantially equal diameters and have substantially equal volumes; and a buoyant section spacing structure connecting the first and second buoyant sections in manner providing a substantially open horizontally extending vertical gap therebetween of about 10% of the diameter of the first cylindrical buoyant section;

a counterweight; and a counterweight spacing structure in the form of an open truss connecting the counterweight to the buoyant tank assembly;

a vertically extending open moon pool is defined through the first and second buoyant sections, the counterweight spacing structure, and the counterweight;

a drilling riser supported by the deck in vertical alignment with the drilling facilities and extending downwardly through the moon pool; and an anchor system comprising a plurality of mooring lines connected to the seafloor on one end and adjacent the bottom of the second cylindrical buoyant section on the other end.

36. A production spar comprising:

a deck;

production facilities supported by the deck;

a buoyant tank assembly, comprising:

a first cylindrical buoyant section connected to the deck;

a second cylindrical buoyant section disposed beneath the first buoyant section the first and second buoyant sections are of substantially equal diameters and have substantially equal volumes below the water line; and a buoyant section spacing structure connecting the first and second buoyant sections in manner providing a substantially open horizontally extending vertical gap therebetween of about 10% of the diameter of the first buoyant section;

a counterweight; and a counterweight spacing structure in the form of an open truss connecting the counterweight to the buoyant tank assembly;

a vertically extending open moon pool is defined through the first and second buoyant sections, the counterweight spacing structure, and the counterweight;

one or more production risers connected to the production facilities and supported by the deck;

one or more export risers connected to the production facilities; and an anchor system comprising a plurality of mooring lines connected to the seafloor on one end and adjacent the bottom of the second cylindrical buoyant section on the other end.

37. A spar platform in accordance with claim 36, further comprising a vertically extending open moon pool defined through the first and second buoyant sections, the counterweight spacing structure, and the counterweight through which the production risers pass.

38. A spar platform in accordance with claim 37 further comprising one or more import risers connected to the production facilities.

39. A spar platform suitable for deployment in an offshore environment that may be subjected to current, the spar platform comprising:

a deck;

a buoyant tank assembly, comprising:

a first buoyant section connected to the deck;

a second buoyant section disposed beneath the first buoyant section; and a buoyant section spacing structure connecting the first and second buoyant sections in manner providing a horizontally extending vertical gap therebetween, whereby low-drag mitigation is provided for vortex induced vibration;

a counterweight; and a counterweight spacing structure connecting the counterweight to the buoyant tank assembly.

40. A spar platform in accordance with claim 39 wherein the first and second buoyant sections are coaxially and vertically aligned cylindrical elements.

41. A spar platform in accordance with claim 40 wherein the first and second buoyant sections are of substantially equal diameters.

42. A spar in accordance with claim 41 wherein height of the horizontally extending vertical gap between the first and second buoyant sections is about 10% of the diameter of the first buoyant section.

43. A spar platform in accordance with claim 40 wherein the first and second buoyant sections have substantially equal volumes.

44. A spar platform in accordance with claim 39 wherein a vertically extending open moon pool is defined through the first and second substantially cylindrical buoyant sections, the counterweight spacing structure, and the counterweight, and further comprising:

one or more risers passing to the deck through the moon pool; and an anchor system comprising a plurality of mooring lines.

45. A spar platform in accordance with claim 39 wherein the first and second buoyant sections are enclosed cylindrical elements and the spar platform further comprises a plurality of risers extending upwardly to the deck, externally to the first and second buoyant members.

46. A spar platform comprising:

a deck;

a buoyant tank assembly, comprising:

a first substantially cylindrical buoyant section connected to the deck;

a second substantially cylindrical buoyant section disposed beneath the first substantially cylindrical buoyant section; and a buoyant section spacing structure connecting the first and second substantially cylindrical buoyant sections in manner providing a horizontally extending vertical gap therebetween, thereby reducing the aspect ratio of the spar platform and reducing vortex induced vibrations;

a counterweight; and a counterweight spacing structure connecting the counterweight to the buoyant tank assembly.

47. A spar platform in accordance with claim 46 wherein the first and substantially cylindrical second substantially cylindrical buoyant sections have substantially equal volumes.

48. A spar in accordance with claim 46 wherein height of the horizontally extending vertical gap between the first and second substantially cylindrical buoyant sections is about 10% of the diameter of the first substantially cylindrical buoyant section.

49. A spar platform in accordance with claim 46 wherein the first and second buoyant sections are coaxially and vertically aligned cylindrical elements.

50. A spar platform in accordance with claim 49 wherein the first and second buoyant sections are of substantially equal diameters.

51. A spar in accordance with claim 50 wherein height of the horizontally extending vertical gap between the first and second substantially cylindrical buoyant sections is about 10% of the diameter of the first substantially cylindrical buoyant section.

52. A spar platform in accordance with claim 51 wherein the first and substantially cylindrical second substantially cylindrical buoyant sections have substantially equal volumes.

53. A spar platform in accordance with claim 49 wherein a vertically extending open moon pool is defined through the first and second substantially cylindrical buoyant sections, the counterweight spacing structure, and the counterweight, and further comprising:

one or more risers passing to the deck through the moon pool; and an anchor system comprising a plurality of mooring lines.

54. A spar platform in accordance with claim 49, further comprising a plurality of risers extending upwardly to the deck, externally to the first and second substantially cylindrical buoyant members.

55. A method for reducing vortex induced vibrations in a spar platform having a deck, a substantially cylindrical buoyant tank assembly, a counterweight and an counterweight spacing structure, the method comprising reducing the aspect ratio of the spar platform by providing one or more substantially open horizontally extending vertical gaps in the buoyant tank assembly below the water line.

56. A method for reducing vortex induced vibrations in a spar platform in accordance with claim 55 wherein reducing the aspect ratio of the spar further comprises placing one or more of the substantially open vertically extending gaps in the buoyant tank assembly as a space provided between vertically aligned cylindrical buoyant sections of substantially similar diameters.

57. A method of reducing vortex induced vibration in accordance with claim 56, further comprising sizing the height of the gap at about 10% of the diameter of the buoyant tank assembly.

58. A method for reducing vortex induced vibrations in a spar platform in accordance with claim 55, further comprising reducing vortex induced vibrations and drag by forming the counterweight spacing structure from a horizontally open truss framework.

59. A spar platform comprising:

a deck;

a buoyant tank assembly, comprising:

a first buoyant section connected to the deck;

a second buoyant section disposed beneath the first buoyant section the first and second buoyant sections being coaxially and vertically aligned cylindrical elements having substantially equal diameters; and a buoyant section spacing structure connecting the first and second buoyant sections in manner providing a horizontally extending vertical gap therebetween;

a counterweight; and a counterweight spacing structure of a horizontally open truss framework connecting the counterweight to the buoyant tank assembly.

* * * * *